US006004144A

United States Patent [19]

Yeh et al.

[11] Patent Number: 6,004,144

[45] Date of Patent: Dec. 21, 1999

[54] ELECTRICAL CARD

[75] Inventors: Joel Jyh-Haur Yeh, San Gabriel, Calif.; Kuo-Cheng Wang, Tu-Cheng; Chine-Shen Wu, Yung-Ho, both of Taiwan

[73] Assignee: Hon Hai Precision Ind. Co., Ltd., Taipei Hsien, Taiwan

[21] Appl. No.: 09/088,962

[22] Filed: Jun. 2, 1998

[51] Int. Cl.[6] ..... H01R 9/09

[52] U.S. Cl. ..... 439/76.1; 439/946; 361/737

[58] Field of Search ..... 439/76.1, 946; 361/737, 818

[56] References Cited

U.S. PATENT DOCUMENTS

| | | | |
|---|---|---|---|
| 5,330,360 | 7/1994 | Marsh et al. | 439/76.1 |
| 5,478,260 | 12/1995 | Kaufman et al. | 439/609 |
| 5,547,397 | 8/1996 | Hirai | 439/946 |
| 5,846,092 | 12/1998 | Feldman et al. | 439/76.1 |

*Primary Examiner*—Steven L. Stephan
*Assistant Examiner*—T C Patel

[57] ABSTRACT

An electrical card for providing a computer system with a signal processing module, includes metallic top and bottom covers, an insulative supporting frame, a circuit board, a first connector, a second connector and a grounding plate. The grounding plate is securely attached to the first connector by engagement between attachment plates of the grounding plate and extension arms of the first connector. The first connector together with the grounding plate are attached to the supporting frame by means of engagement between L-shaped interlocking members of the first connector and L-shaped interlocking recesses of the supporting frame. The supporting bracket is attachably received in the bottom cover, the second connector is mounted to one end of the circuit board, and the circuit board is received within the supporting bracket whereby the grounding plate forms a grounding path from grounding pads of the circuit board to the bottom cover. Finally, the top cover is engaged with the bottom cover to complete assembly of the electrical card.

8 Claims, 8 Drawing Sheets

ELECTRICAL CARD

BACKGROUND OF THE INVENTION

1. Field of the Invention

The present invention relates to an electrical card, and particularly to an electrical card having a grounding plate for providing a grounding path from a circuit board received in the card to metallic covers of the card, and having a first connector securely interlocked with a supporting frame within the card.

2. The Prior Art

A conventional electrical input/output card comprises a pair of separate metallic top and bottom covers configured to be engaged together, a supporting frame, a circuit board having electrical elements mounted thereon, and primary and secondary electrical connectors. In assembly, the circuit board is equipped with the connectors at opposite ends thereof and then attached to the supporting frame before being sandwiched between the top and bottom covers.

Since the primary electrical connector of such a conventional electrical card is only fixed to the supporting frame by means of a rectangular protrusion received in a corresponding recess to prevent longitudinal movement of the circuit board with regard to the supporting frame, lateral movement of the circuit board is still possible which may adversely affect signal transmission between the card and the related system. Such prior art electrical cards are disclosed in U.S. Pat. Nos. 5,242,310, 5,339,222, 5,397,857, and 5,413,490.

Furthermore, a grounding plate is often disposed on an electrical card connector for suppressing electromagnetic interference. However, since the grounding plate is fixed to the card connector and not received within the electrical card, electrostatic accumulation within the card cannot be properly discharged which may adversely affect signal transmission. Such a card connector is disclosed in U.S. Pat. No. 5,478,260.

Hence, an improved I/O electrical card device is needed to eliminate the above mentioned defects of current I/O card devices.

SUMMARY OF THE INVENTION

Accordingly, an objective of the present invention is to provide an electrical card having an interlocking mechanism for securely engaging a first electrical connector with a supporting frame whereby all inner components of the card are firmly secured therein.

Another objective of the present invention is to provide an electrical card having a grounding plate attached to a first connector received therein, which provides a grounding path from a circuit board to a metallic cover thereof.

According to an aspect of the present invention, an electrical card for providing a computer system with a signal processing module, includes metallic top and bottom covers, an insulative supporting frame, a circuit board, a first connector, a second connector and a grounding plate.

The grounding plate includes a pair of attachment plates extending forward from each distal end thereof, and a plurality of grounding fingers extending forward between the attachment plates. The first connector includes a pair of extension arms forwardly extending from opposite distal ends of a housing thereof and an L-shaped interlocking member projecting outward and rearward from each distal end of the housing. The grounding plate is attached to the first connector by engagement between the attachment plates and the extension arms. The supporting bracket includes two extension rods, a first connecting portion located between the rods at one end thereof and forming staggered recesses therein, and a second connecting portion located between the rods at the other end. Each rod forms an L-shaped recess at the first end thereof.

In assembly, the first connector together with the grounding plate is mounted to the first connecting portion of the supporting frame by means of interlocking engagement between the L-shaped members of the first connector and the L-shaped recesses of the supporting frame wherein the grounding fingers of the grounding plate are received in the corresponding staggered recesses of the first connecting portion. The supporting frame is then secured to the bottom cover whereby embossments formed on the grounding plate contact the bottom cover. The second connector is mounted to one end of the circuit board, then the circuit board is received within the supporting bracket, whereby the grounding fingers of the grounding plate contact corresponding grounding contact pads formed on a bottom surface of the opposite end of the circuit board for providing a grounding path from the circuit board to the bottom cover and contacts of the first connector electrically connect with corresponding contact pads on a top surface of the circuit board. Finally, the top cover is engaged with the bottom cover to complete assembly of the electrical card.

These and additional objectives, features, and advantages of the present invention will become apparent after reading the following detailed description of the preferred embodiment of the invention taken in conjunction with the appended drawings.

DETAILED DESCRIPTION OF THE PREFERRED EMBODIMENT

Figure 1:
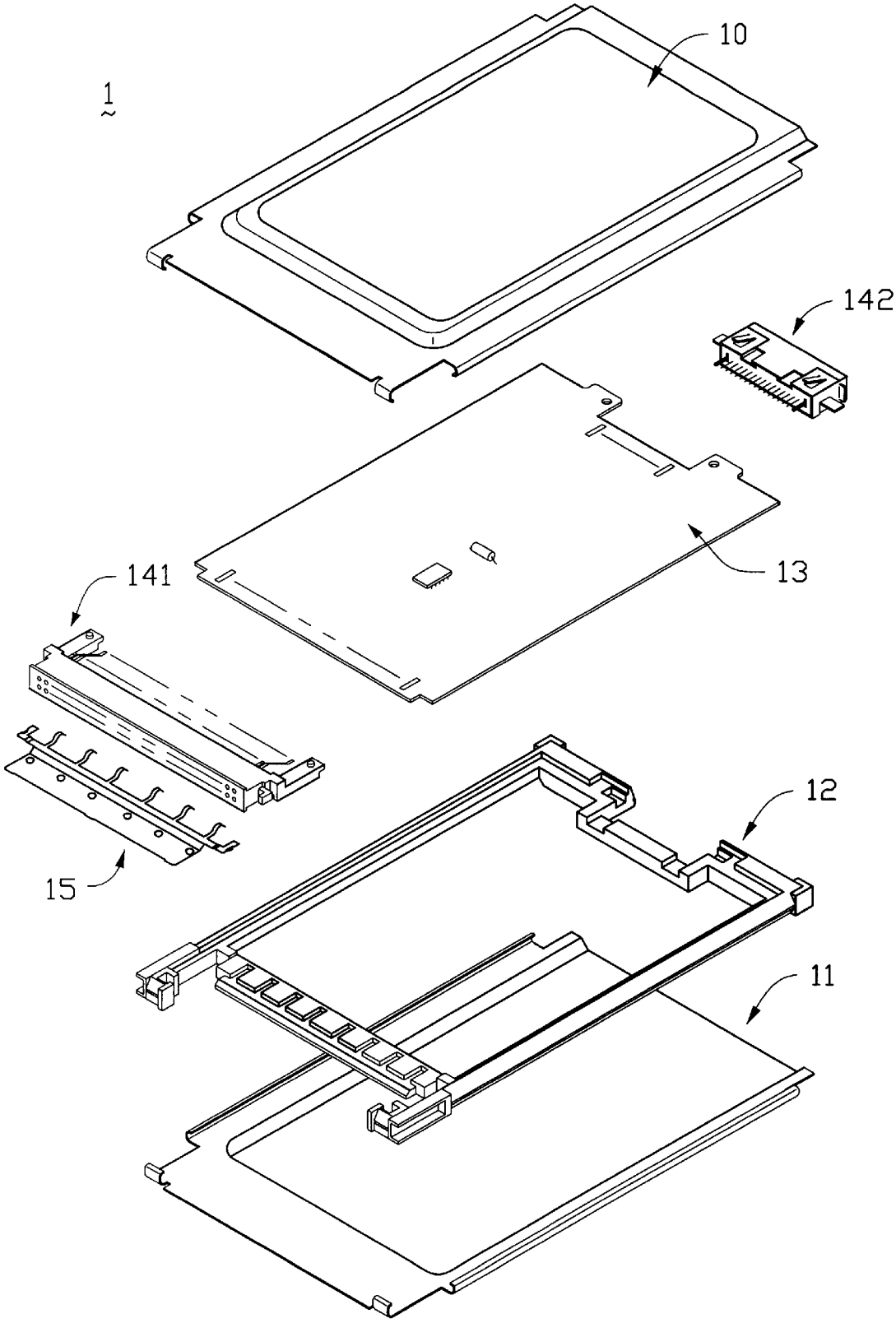
FIG. 1 is an exploded view of the I/O electrical card in accordance with the present invention showing two covers, a supporting frame, a circuit board, a first electrical connector, a second electrical connector, and a grounding plate.

Reference will now be made in detail with regard to the preferred embodiment of the present invention. Referring to FIG. 1, an electrical card 1 for providing a computer system with a signal processing module includes metallic top and bottom covers 10, 11, an insulative supporting frame 12, a circuit board 13, a first connector 141, a second connector 142 and a grounding plate 15. The first connector 141 is adapted to electrically mate with a corresponding connector (not shown) of the computer system, and the second connector 142 is adapted to mate with an exterior plug (not shown) from another electrical device such as a printer. The circuit board 13 is mounted with a number of different electrical elements which provide a specific function.

Figure 2:
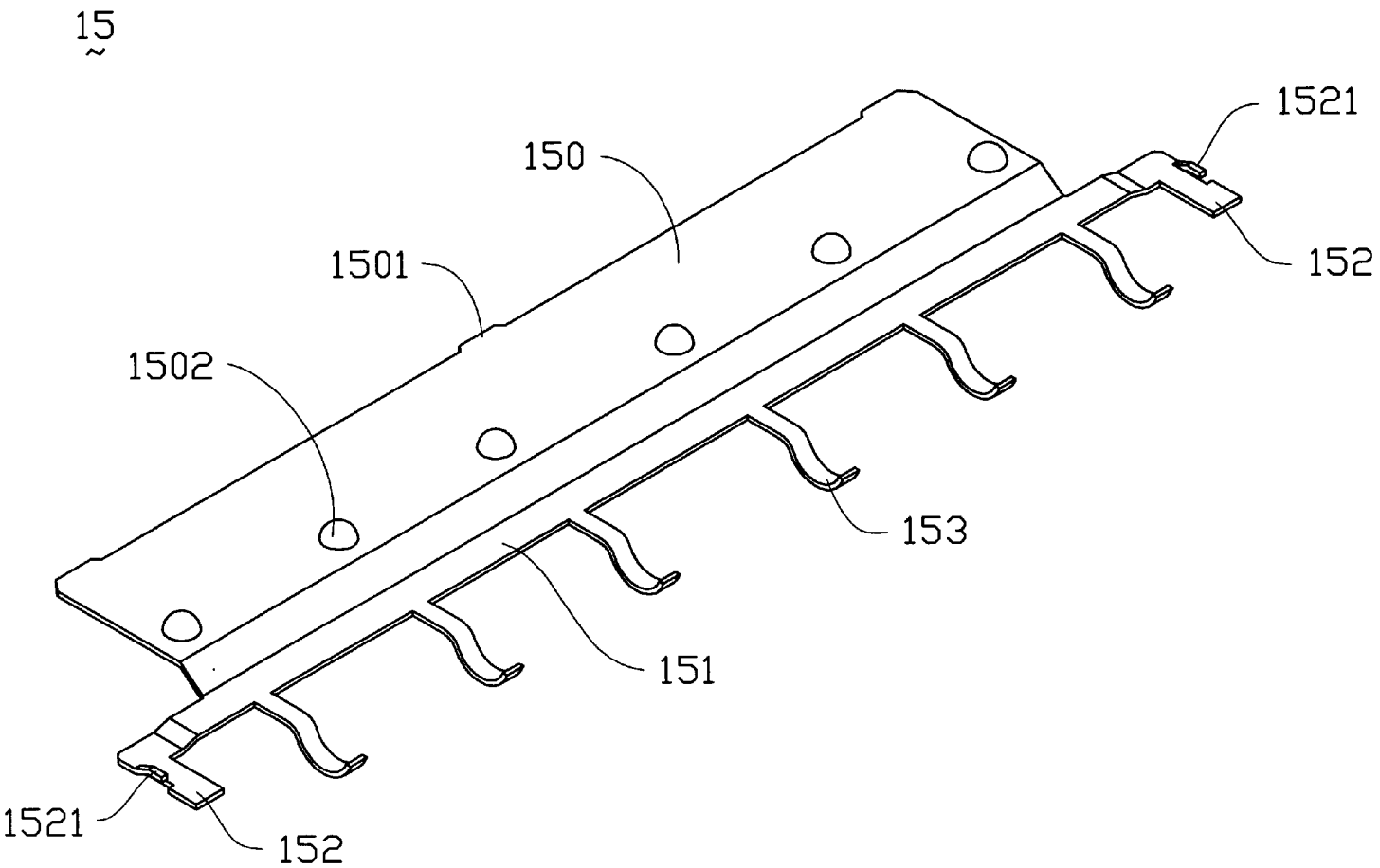
FIG. 2 is a perspective view of the grounding plate.

Referring to FIG. 2, the grounding plate 15 made by stamping a metal sheet includes an elongate main body 150, an extension flange 151 attached to a longitudinal side of the body 150 and extending beyond distal ends thereof, an attachment plate 152 extending forward from each distal end of the flange 151, and a plurality of grounding fingers 153 extending forward from the flange 151 between the attachment plates 152. Three engaging tabs 1501 rearwardly project from the body 150 and a plurality of embossments 1502 upwardly protrude from the main body along the longitudinal side from which the flange 151 extends. Each attachment plate 152 forms a resilient attachment finger 1521 projecting upward and forward therefrom.

Figure 3:
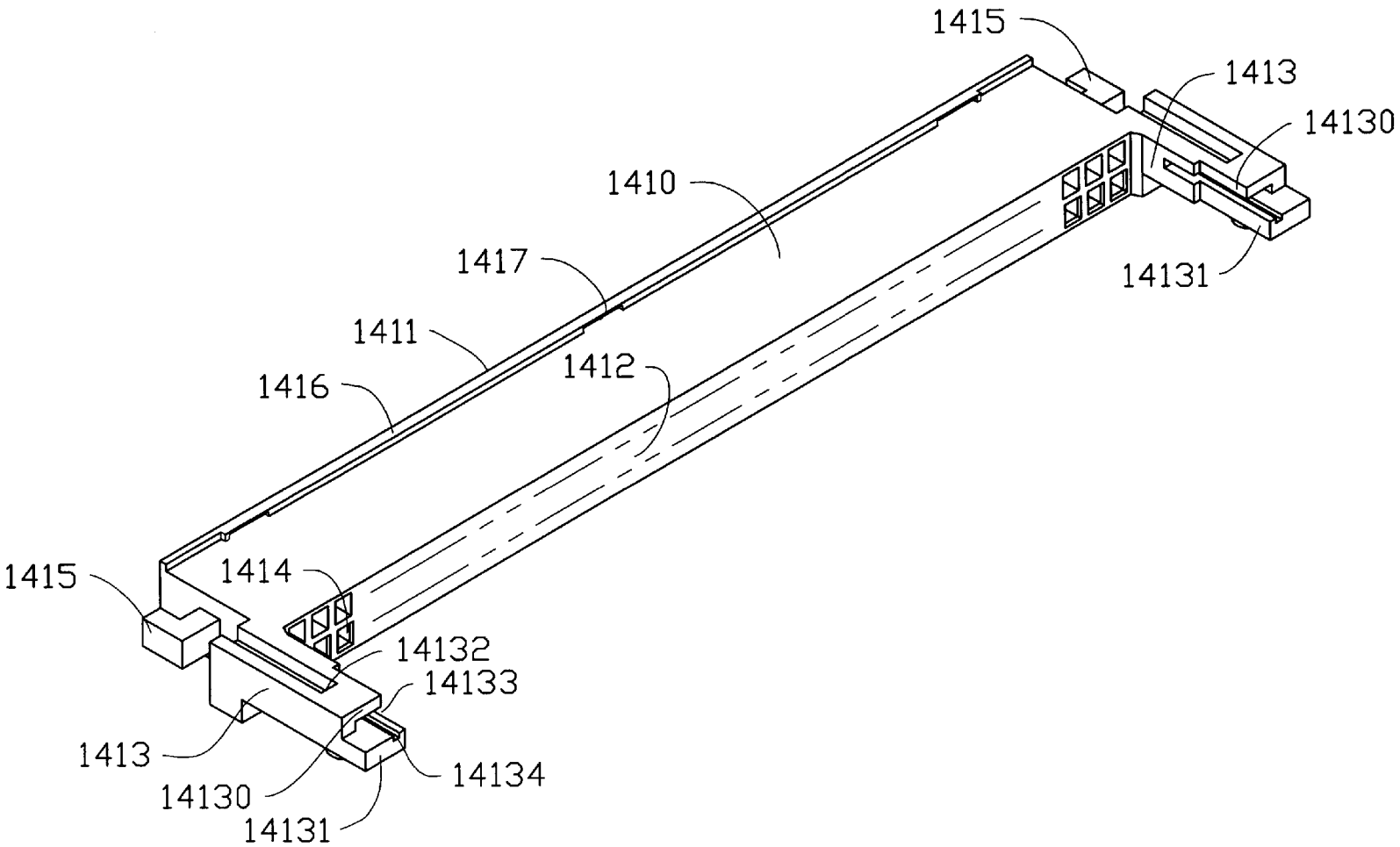
FIG. 3 is a perspective view of the first connector.

The first connector 141, as shown in FIG. 3, includes an insulative housing 1410 having a mating face 1411 and a mounting face 1412, an extension arm 1413 forwardly extending from each distal end of the housing 1410, a plurality of contact receiving passageways 1414 defined through the housing between the mating and mounting faces 1411, 1412, and an L-shaped interlocking member 1415 projecting outward and rearward from each distal end of the housing 1410. An upper ridge 1416 longitudinally formed along a top of the housing 1410 adjacent to the mating face 1412, defines three engaging recesses 1417 therein. Each extension arm 1413 forms an upper portion 14130, a lower portion and an opening 14133 therebetween. Each opening 14133 is exposed to a space (not labeled) defined between the two extension arms 1413 and the housing 1410. Each upper portion 14130 defines a slot 14132 therethrough which is exposed to a rear end thereof, and each lower portion 14131 defines a longitudinal groove 14134 along an upper surface thereof.

Figure 4:
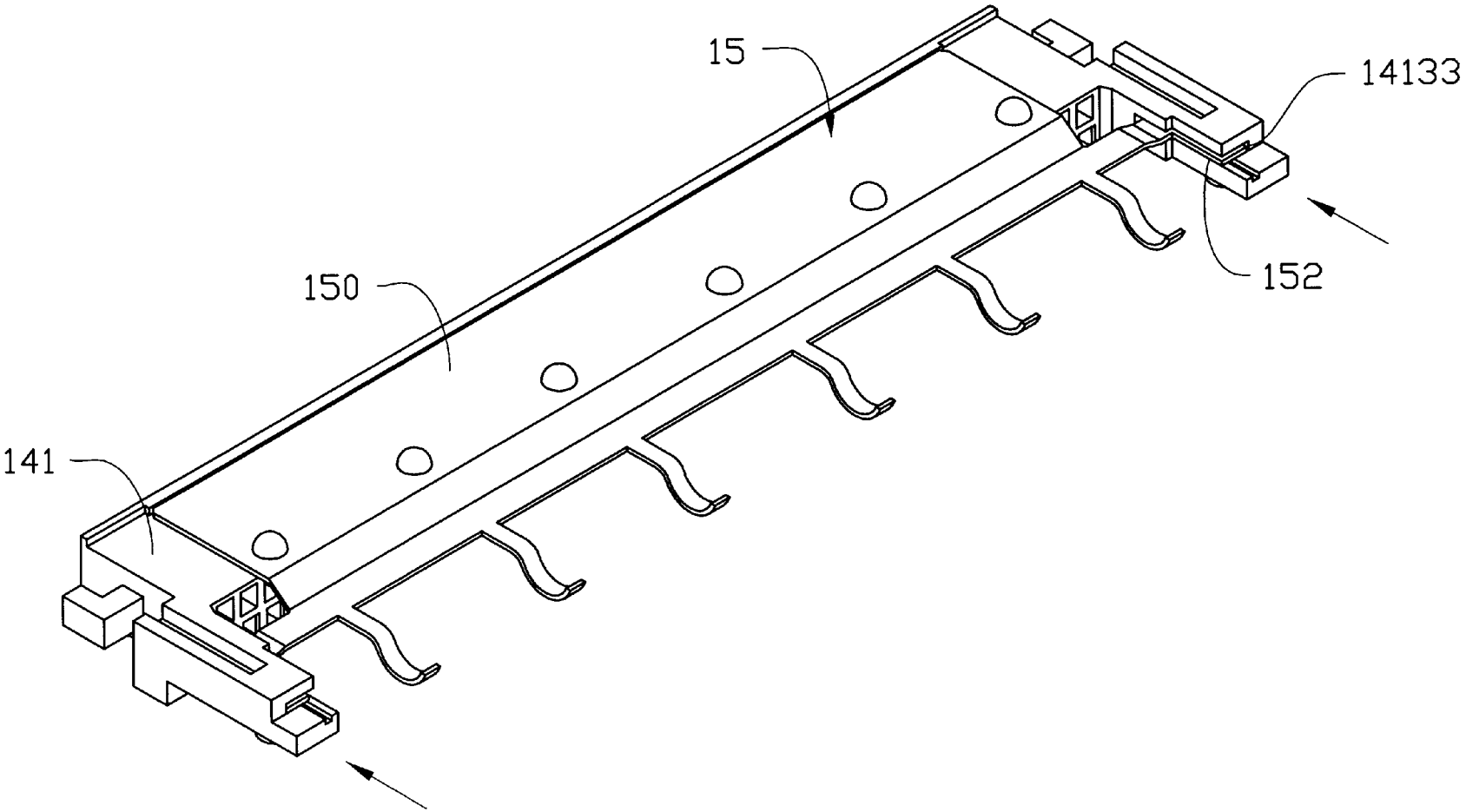
FIG. 4 is a perspective view showing the grounding plate attached to the first connector.

The grounding plate 15 is attached to the first connector 141 as shown in FIG. 4. The attachment plates 152 of the grounding plate 15 are brought to be received in the corresponding openings 14133 of the first connector 141, and a bottom surface (not labeled) of the main body 150 of the grounding plate 15 abuts against a top surface (not labeled) of the housing 1410 of the first connector 141. The grounding plate 15 is then pushed in the direction as indicated by the arrow whereby the attachment fingers 1521 are received in the corresponding grooves 14134 and deform as they abut and slide along a bottom surface (not labeled) of the upper portion 14130 of the extension arm 1413. When the engaging tabs 1501 of the grounding plate 15 are received in the corresponding engaging recesses 1417 of the first connector 141, the attachment fingers 1521 resume their original shape and are received in the slot 14132, whereby the grounding plate 15 is firmly attached to the first connector 141.

Figure 5:
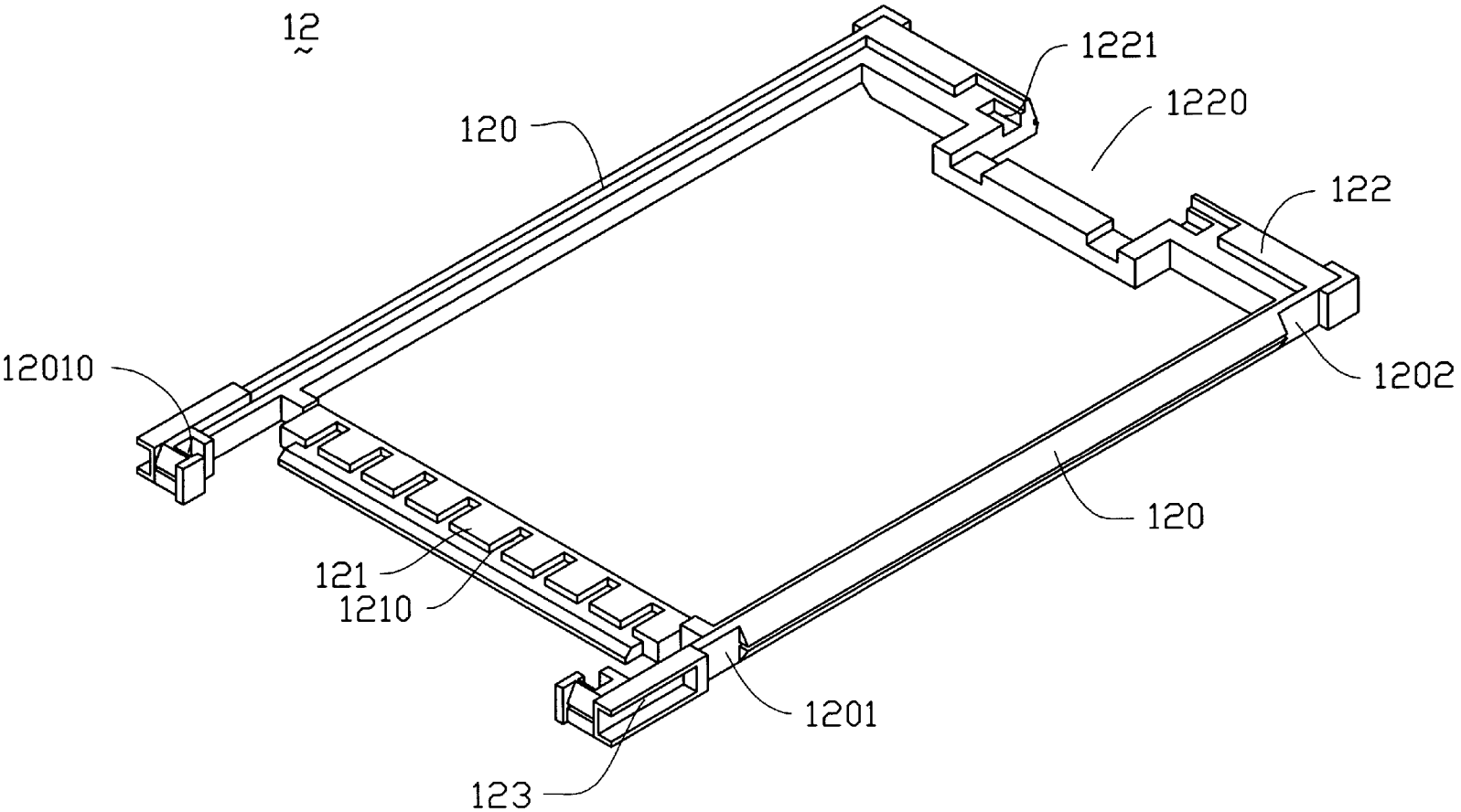
FIG. 5 is a perspective view of the supporting frame.
Figure 6:
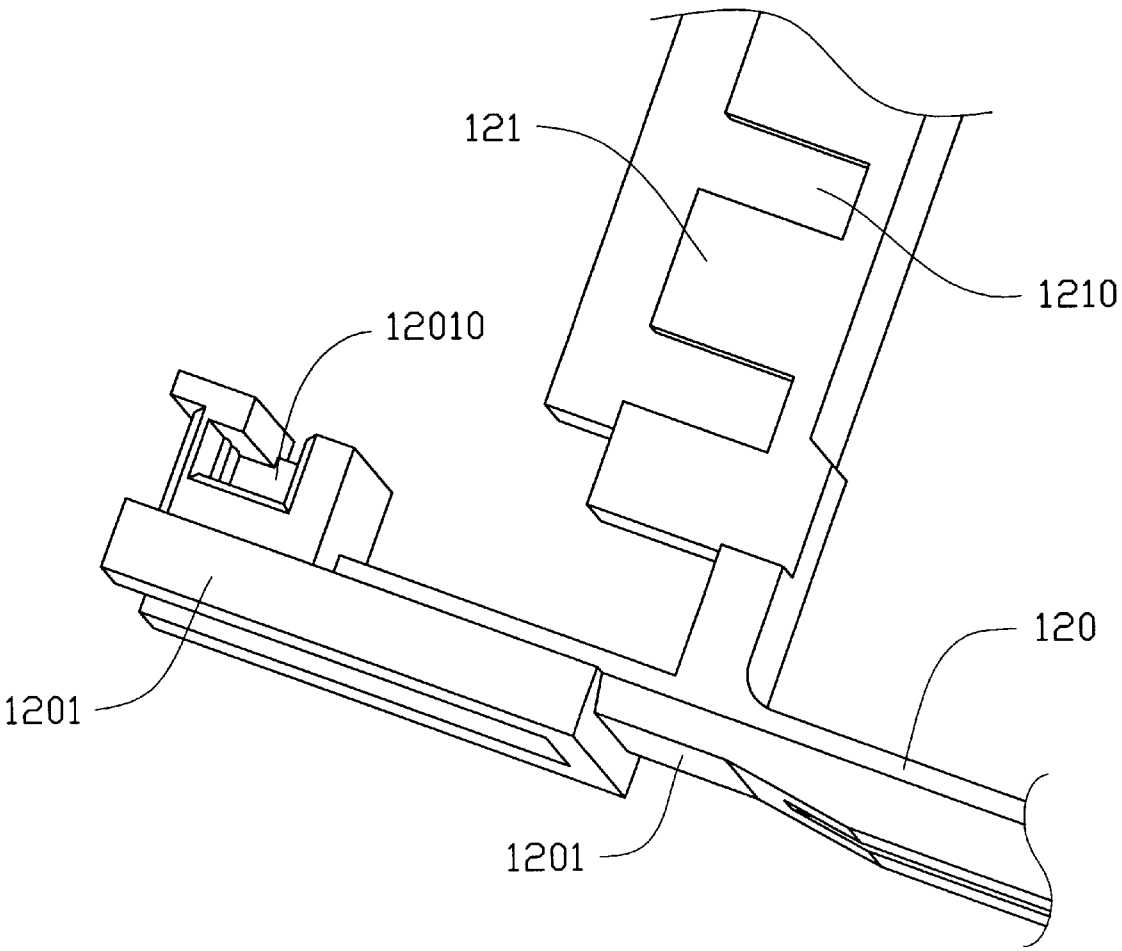
FIG. 6 is an enlarged view of FIG. 5 showing an interlocking recess of the supporting frame.

The supporting frame 12 as shown in FIG. 5 includes two extension rods 120 each having a first end 1201 and a second end 1202, a first connecting portion 121 mounted between the rods 120 at the first end 1201 thereof, and a second connecting portion 122 mounted between the rods 120 at the second end 1202 thereof. The first connector portion 121 defines a plurality of staggered recesses 1210 thereon. The second connector portion 122 defines a space 1220 for receiving the second connector 142 therein and two mounting recesses 1221 adjacent to the space 1220. Each rod 120 forms an interlocking extension 123 extending from the first end 1201 thereof. The interlocking extension 1201, more clearly seen in FIG. 6, defines an L-shaped recess 12010 in a top portion thereof. The recess 12010 is configured to snugly receive the L-shaped interlocking member 1415 of the first connector 141.

Figure 7:
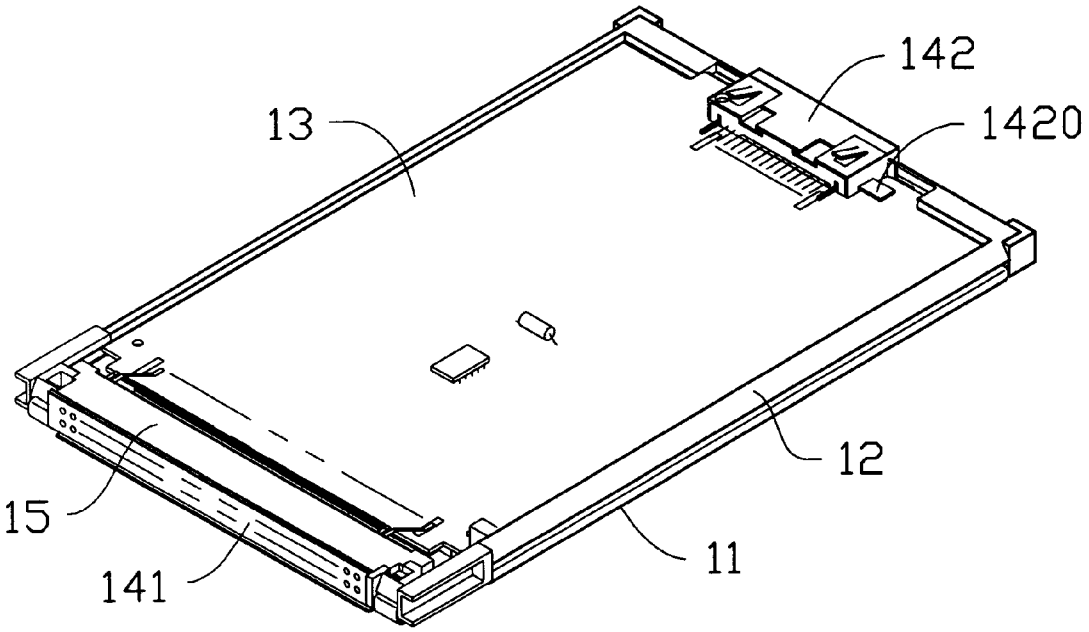
FIG. 7 is a partially assembled view of FIG. 1 without the top cover attached thereto.
Figure 8:
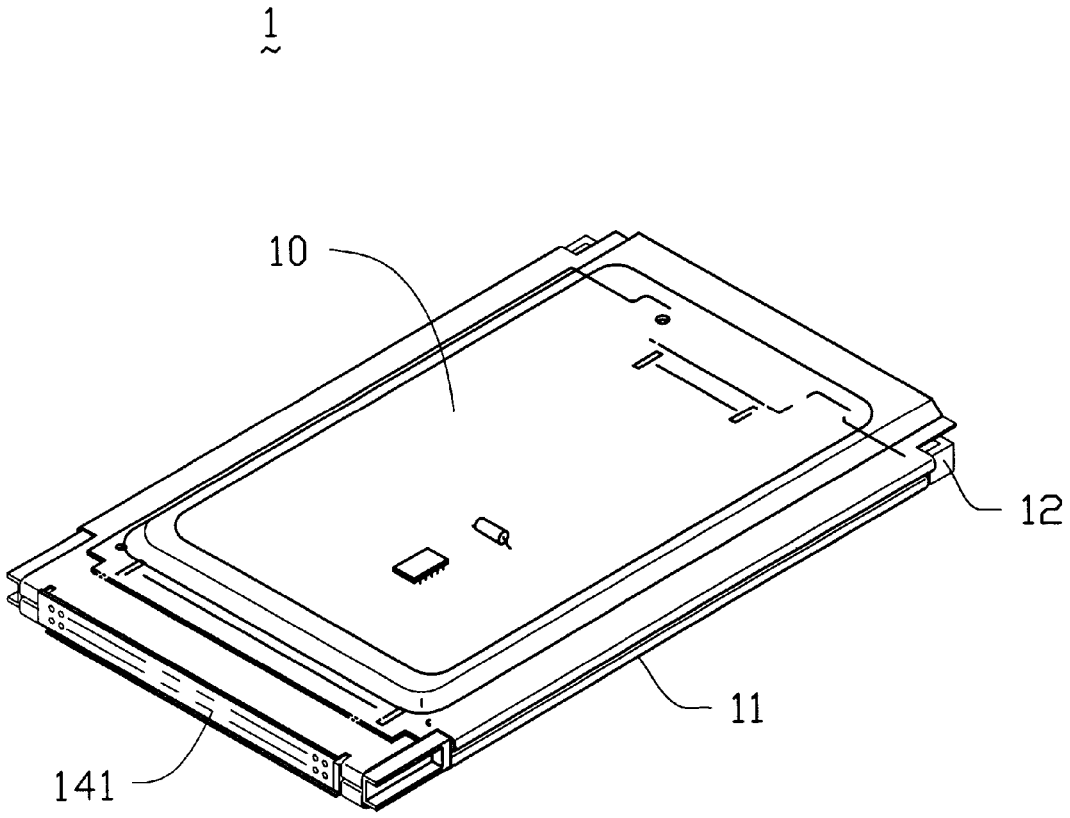
FIG. 8 is a fully assembled view of FIG. 1.

In assembly, the grounding plate 15 is attached to the first connector 141 as previously described. The first connector 141 together with the grounding plate 15 are attached to the supporting frame 12 by inserting the L-shaped members 1415 of the first connector 141 into the corresponding L-shaped recesses 12010 of the supporting frame 12, whereby the grounding fingers 153 of the grounding plate 15 are received in the corresponding staggered recesses 1210 of the supporting frame 12. The supporting frame 12 is then attachably received in the bottom cover 11, whereby the embossments 1502 of the grounding plate 15 abut against the bottom cover 11. The second connector 142 is mounted to one end of the circuit board 13 then the circuit board 13 is attached to the supporting bracket 12 whereby mounting ears 1420 formed extending from distal ends of the second connector 142 are received in the corresponding mounting recesses 1221 of the supporting bracket 12, the grounding fingers 153 of the grounding plate 15 contact grounding contact pads formed on a bottom surface of the circuit board 13, and contacts of the first connector 141 contact corresponding contact pads on a top surface of the first connector 141, as shown in FIG. 7. Finally, the top cover 10 is engaged with the bottom cover 11 to complete assembly of the electrical card 1 as shown in FIG. 8.

With this structure, the L-shaped interlocking members 1415 received in the L-shaped recesses 12010 of the supporting frame 12 restrict both lateral and longitudinal movement of the inner components of the card 1 with respect to the covers 10, 11. In addition, the provision the grounding plate 15 connecting grounding pads (not shown) of the circuit board 13 to the covers 10, 11 of the card 1 ensures that signal transmission will not be adversely affected due to electrostatic discharge.

While the present invention has been described with reference to the specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

Therefore, persons of ordinary skill in this field are to understand that all such equivalent structures are to be included within the scope of the following claims.

We claim:

1. An electrical card for providing a computer system with a signal processing module, comprising:

a metallic top cover and a bottom cover;

an insulative supporting frame attached between the top and bottom covers and forming at least an interlocking extension extending from an end thereof and defining an L-shaped interlocking recess therein;

a first connector including an insulative housing having a mating face and a mounting face, a plurality of contact receiving passages defined through the housing between the mating and mounting faces, and at least an interlocking member projecting from an end of the housing, each interlocking member having an outwardly extending portion and a laterally extending portion for being snugly received in the corresponding interlocking recess of the supporting frame for restricting both lateral and longitudinal movement of inner components of the card with respect to the covers;

a grounding plate attached to the first connector, having an elongate main body and a plurality of grounding fingers extending forward therefrom; and a circuit board attached to the supporting frame;

wherein a top surface of the grounding plate abuts against either of the covers, and the grounding fingers of the grounding plate are soldered to corresponding grounding pads formed on a bottom surface of the circuit board.

2. An electrical card for providing a computer system with a signal processing module, comprising:

a metallic top cover and a bottom cover;

an insulative supporting frame attached between the top and bottom covers;

a first connector firmly attached to the supporting frame and including an insulative housing having a mating face and a mounting face, a plurality of contact receiving passages defined through the housing between the mating and mounting faces, and an extension arm forwardly extending from each distal end of the housing, each extension arm including an upper portion and a lower portion with an opening defined therebetween;

a grounding plate having an elongate main body, a pair of attachment plates extending forward from distal ends thereof, and a plurality of grounding fingers extending forward therefrom between the attachment plates, the attachment plates being inserted into the corresponding openings of the first connector; and a circuit board attached to the supporting frame;

wherein a top surface of the grounding plate abuts against either of the covers, and the grounding fingers of the grounding plate are soldered to corresponding grounding pads formed on a bottom surface of the circuit board.

3. The electrical card as described in claim 2, wherein the upper portion of the extension arm of the first connector defines a slot from a middle portion thereof and exposed to a rear end thereof.

4. The electrical card as described in claim 3, wherein each attachment plate of the grounding plate forms a resilient attachment finger projecting therefrom, the attachment fingers deforming as they abut and slide along a bottom surface of the upper portion of the extension arm, and the attachment fingers resuming their original shape when reaching the slot.

5. The electrical card as described in claim 4, wherein each lower portion of the extension arms of the first connector defines a longitudinal groove along an upper surface thereof and the corresponding attachment finger of the grounding plate is received therein when the attachment finger is deformed by the upper portion of the extension arm.

6. The electrical card as described in claim 2, wherein the supporting frame defines a plurality of staggered recesses thereon and the grounding fingers of the grounding plate extend through the staggered recesses, respectively.

7. The electrical card as described in claim 2, wherein an upper ridge is longitudinally formed along a top of the housing of the first connector adjacent to the mating face and defines at least an engaging recess therein, and at least an engaging tab rearwardly projects from the body of the grounding plate for reception in the at least one engaging recess of the first conector.

8. An electrical card for providing a computer system with a signal processing module, comprising:

a metallic top cover and a bottom cover;

an insulative supporting frame attached between the top and bottom covers and forming at least an interlocking extension extending from an end thereof and defining an interlocking recess therein;

a first connector including an insulative housing having a mating face and a mounting face, a plurality of contact receiving passages defined through the housing between the mating and mounting faces, at least an interlocking member projecting from an end of the housing, and an extension arm forwardly extending from each distal end of the housing and including an upper portion and a lower portion with an opening defined therebetween; and a grounding plate having an elongate main body, a pair of attachment plates extending from distal ends thereof, and a plurality of grounding fingers extending forward therefrom between the attachment plates, the attachment plates being inserted into the corresponding openings of the first connector.

* * * * *